US006947819B2

(12) United States Patent
Nelson et al.

(10) Patent No.: US 6,947,819 B2
(45) Date of Patent: Sep. 20, 2005

(54) SWIVEL JOINT FOR A WORK MACHINE

(75) Inventors: James M. Nelson, Peoria, IL (US); Dennis D. Wetterich, Millbrook, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/292,956

(22) Filed: Nov. 13, 2002

(65) Prior Publication Data

US 2004/0093142 A1 May 13, 2004

(51) Int. Cl.[7] ..... G06F 19/00
(52) U.S. Cl. ..... 701/50; 172/25; 172/518
(58) Field of Search ..... 701/50, 2; 172/25, 172/518; 37/403, 417, 443, 446, 410, 903

(56) References Cited

U.S. PATENT DOCUMENTS

| | | | | |
|---|---|---|---|---|
| 3,662,335 A | | 5/1972 | Fritze | 340/448 |
| 3,969,714 A | | 7/1976 | Greer | 340/679 |
| 4,633,966 A | | 1/1987 | Fotheringham | 180/253 |
| 5,019,761 A | | 5/1991 | Kraft | 318/568.11 |
| 5,416,627 A | | 5/1995 | Wilmoth | 398/129 |
| 5,469,694 A | | 11/1995 | Panousheck et al. | 56/10.2 E |
| 5,712,552 A | | 1/1998 | Hirai et al. | 318/568.1 |
| 5,742,228 A | | 4/1998 | Levy | 340/429 |
| 5,949,565 A | | 9/1999 | Ishida | 398/131 |
| 6,095,181 A | | 8/2000 | Irwin | 137/351 |
| 6,112,139 A | | 8/2000 | Schubert et al. | 701/2 |
| 6,119,054 A | * | 9/2000 | Miki et al. | 700/275 |
| 6,266,901 B1 | * | 7/2001 | Kanda et al. | 37/403 |
| 6,317,676 B1 | * | 11/2001 | Gengler et al. | 701/82 |
| 6,522,964 B1 | * | 2/2003 | Miki et al. | 701/50 |
| 6,662,881 B2 | * | 12/2003 | Domann | 172/272 |
| 2002/0153748 A1 | * | 10/2002 | Sakyo et al. | 296/190.08 |
| 2004/0032233 A1 | * | 2/2004 | Miyazaki et al. | 318/568.12 |

* cited by examiner

*Primary Examiner*—Thomas G. Black
*Assistant Examiner*—Christine M. Behncke
(74) *Attorney, Agent, or Firm*—Finnegan, Henderson, Farabow, Garrett & Dunner

(57) ABSTRACT

A joint for a work machine having a body and a base is provided. A first member is connected to one of the body and the base and a second member is connected to the other of the body and the base. The second member is engaged with the first member to allow the body to swivel relative to the base. A transmitter is connected to one of the body and the base and is operable to transmit an informational signal. A receiver is connected to the other of the body and the base and is operable to receive the informational signal.

32 Claims, 2 Drawing Sheets

SWIVEL JOINT FOR A WORK MACHINE

TECHNICAL FIELD

The present invention is directed to a joint for a work machine and, more particularly, to a system and method for transmitting data across a swivel joint in a work machine.

BACKGROUND

A work machine typically includes a work implement that may be used to perform any of a variety of construction, demolition, and/or earth moving tasks. An operator may instruct the work machine to move the work implement and thereby complete a particular task by controlling the movement and position of one or more hydraulic actuators that are connected to the work implement. The hydraulic actuators provide the power required to move a load of, for example, earth or debris.

A typical work machine includes a base that is configured to move the work machine around and/or between work sites. The base may include a ground engaging device, such as, for example, tracks or wheels. Alternatively, the base may be adapted for movement in water and may be a water vehicle, such as, for example, a barge.

When the work machine is positioned at a work site, an operator may move the work implement relative to the base to complete a particular task. Typically, the work implement is configured for a "crowd" movement and a "swivel" movement. The crowd movement allows the work implement to be moved towards and away from the base. In addition, the crowd movement allows the work implement to be moved vertically relative to the base.

The swiveling movement allows the work implement to be moved tangentially or circumferentially relative to the base. In certain work machines, the work implement is mounted on a cab, which is connected to the base by a "swivel joint." The "swivel joint" allows the cab and the attached work implement to be swiveled, or rotated about a vertical axis, relative to the base.

Improving the range of motion of the work implement relative to the base may increase the efficiency of the work machine. A work machine that provides a greater range of motion for the work implement may require less repositioned at a work site than a work machine with a smaller range of motion. A task may be completed in less time if the work machine does not need to be repositioned at the work site.

One limitation on the range of motion of a work machine is the control lines and wires that are included in the joints of the work machine. These control lines and wires may be used to transmit both informational signals and/or hydraulic fluid to the different parts of the work machine. In many cases, the range of motion of a particular joint is limited to prevent these control lines and wires from becoming tangled or frayed.

This is particularly a problem in a swivel joint that connects the cab of a work machine with the base. Several control lines and/or wires are typically required to connect the cab with the base so that operational instructions from the operator may be transmitted to the base. In many cases, the work machine is designed to prevent the cab and work implement from swiveling or rotating through a full 360° of rotation to thereby prevent these control wires from becoming tangled or frayed. This limitation on rotation results in a decreased range of motion of the work implement and a decreased efficiency of the work machine.

The swivel joint of the present invention solves one or more of the problems set forth above.

SUMMARY OF THE INVENTION

One aspect of the present invention is directed to a joint for a work machine having a body and a base. A first member is connected to one of the body and the base and a second member is connected to the other of the body and the base. The second member is engaged with the first member to allow the body to swivel relative to the base. A transmitter is connected to one of the body and the base and is operable to transmit an informational signal. A receiver is connected to the other of the body and the base and is operable to receive the informational signal.

In another aspect, the present invention is directed to a method of transmitting data in a work machine including a base, a body, and a joint connecting the base to the body. An informational signal is generated in one of the base and the body of the work machine. A wireless transmission containing the informational signal is transmitted across the joint with a transmitter that is connected with the one of the base and body of the work machine. The informational signal is received through a receiver that is connected with the other of the base and body of the work machine.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
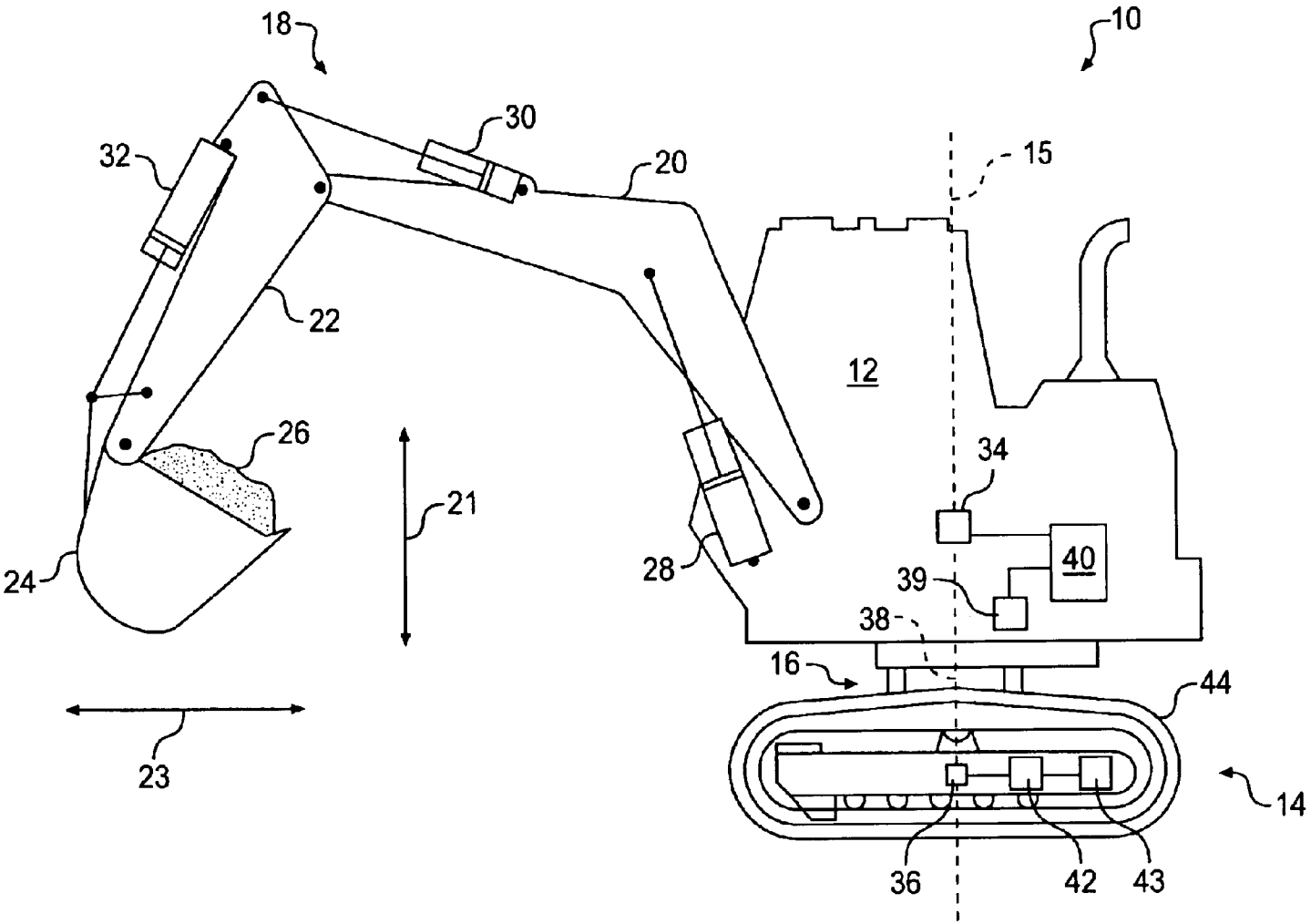
FIG. 1 is a schematic and diagrammatic representation of a work machine having a joint in accordance with an exemplary embodiment of the present invention.

An exemplary embodiment of a work machine 10 is illustrated in FIG. 1. Work machine 10 includes a body 12. Body 12 may include a cab or other such seating area for an operator. Body 12 may include one or more control devices (not shown), such as, for example, a joystick, a lever, or a pedal, that allow the operator to provide operational instructions to work machine 10.

Work machine 10 also includes a base 14 that is configured to move work machine 10 around a job site or between job sites. Base 14 may include a ground engaging device 44. Ground engaging device 44 may be, for example, a set of tracks or a set of wheels. It should be noted that base 14 may be configured to move work machine 10 in a water environment. Accordingly, base 14 may be a water-based vessel such as, for example, a barge.

Base 14 may also include a motor 43, a steering mechanism (not shown), and any other equipment commonly associated with the base of a work machine, such as, for example, an engine and a fuel supply. Motor 43 may be, for example, a hydraulic motor, that provides power to ground engaging device 44 to move work machine 10. The steering mechanism may be used to control the motion or direction of the ground engaging device to guide base 14 in a desired direction.

Work machine 10 may also include a joint 16 that connects body 12 to base 14. Joint 16 may be configured to allow body 12 to swivel relative to base 14. Joint 16 may allow body 12 to rotate around an axis 15 relative to base 14.

Figure 2:
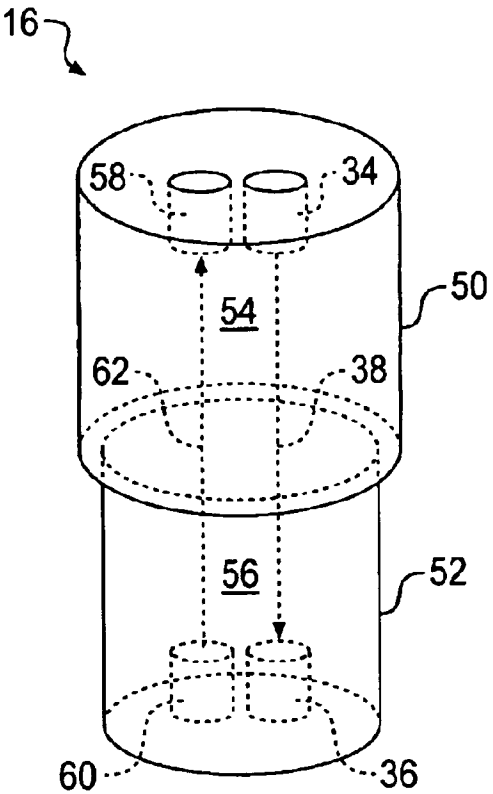
FIG. 2 is a schematic and diagrammatic representation of a joint in accordance with an exemplary embodiment of the present invention.

FIG. 2 schematically and diagrammatically illustrates an exemplary embodiment of joint 16. As shown, joint 16 may include a first member 50 and a second member 52. First member 50 may have a substantially cylindrical shape and define an opening 54. Second member 52 may also have a substantially cylindrical shape and define an opening 56. Second member 52 may be disposed within opening 54 of first member 50 so that second member 52 may rotate with respect to first member 50. One skilled in the art will recognize that first and second members 50 and 52 may be engaged in any other manner that allows for first and second members 50 and 52 to rotate relative to each other.

One skilled in the art will recognize that joint 16 may also include one or more bearings (not shown). The bearings may provide support for first and second members 50 and 52 to reduce the amount of friction generated between the first and second members 50 and 52 when body 12 is rotated relative to base 14. In addition, one or more seals (not shown) may be disposed between first and second members 50 and 52.

First member 50 may be connected to body 12 and second member 52 may be connected to base 14. Each of first and second members 50 and 52 may include a flange or another structure that allows the respective member to be connected to body 12 or base 14. When connected in this manner, a rotation of first member 50 relative to second member 52 will result in a corresponding rotation of body 12 relative to base 14.

Joint 16 may be configured for unlimited rotation of first member 50 relative to second member 52. For example, first member 50 may rotate through multiple 360° rotations without reaching an end of travel. One skilled in the art will recognize, however, that joint 16 may be configured for any range of rotation, such as, for example, a range of rotation of less than 360°.

Work machine 10 may include a swivel actuator 39. Swivel actuator 39 may be one or more hydraulically powered actuators, such as, for example, fluid motors or hydraulic cylinders. Alternatively, swivel actuator 39 may be any other device readily apparent to one skilled in the art as capable of rotating first member 50 relative to second member 52. Swivel actuator 39 may be directly connected to one of the first and second members 50 and 52. Alternatively, swivel actuator 39 may be indirectly connected to one of first and second members 50 and 52 through, for example, a connection with one of body 12 and base 14. Pressurized fluid may be introduced to swivel actuator 39 to exert a force on one of the first and second members 50 and 52 (or one of body 12 and base 14) to thereby cause body 12 to rotate relative to base 14. The direction and rate of the pressurized fluid flow to swivel actuator 39 may be controlled to thereby control the direction and speed of movement of first member 50 relative to second member 52.

As further illustrated in FIG. 1, work machine 10 may include a work implement 18 that is connected to body 12. Work implement 18 may include a ground engaging tool 24. Ground engaging tool 24 may be any type of mechanism commonly used on a work machine to move a load 26 of earth, debris, or other material. For example, ground engaging tool 24 may be a shovel, a clamshell, a grapple, or a blade.

Work implement 18 may further include a crowd mechanism. Crowd mechanism may include, for example, a boom 20 and a stick 22. Boom 20 and stick 22 are configured to move ground engaging tool 24 vertically relative to body 12 (as indicated by arrow 21) and horizontally relative to body 12 (as indicated by arrow 23).

As shown in FIG. 1, boom 20 may be pivotally mounted on body 12. A first actuator 28 may be connected between boom 20 and body 12. First actuator 28 may be one or more hydraulically powered actuators, such as, for example, fluid motors or hydraulic cylinders. Alternatively, first actuator 28 may be any other device readily apparent to one skilled in the art as capable of moving boom 20 relative to body 12. Pressurized fluid may be introduced to first actuator 28 to move boom 20 relative to body 12. The direction and rate of the pressurized fluid flow to first actuator 28 may be controlled to thereby control the direction and speed of movement of boom 20 relative to body 12.

Stick 22 may be pivotally connected to one end of boom 20. A second actuator 30 may be connected between stick 22 and boom 20. Second actuator 30 may be one or more hydraulically powered actuators, such as, for example, fluid motors or hydraulic cylinders. Alternatively, second actuator 30 may be any other device readily apparent to one skilled in the art as capable of moving stick 22 relative to boom 20. Pressurized fluid may be introduced to second actuator 30 to move stick 22 relative to boom 20. The direction and rate of the pressurized fluid flow to second actuator 30 may be controlled to thereby control the direction and speed of movement of stick 22 relative to boom 20.

Ground engaging tool 24 may be pivotally connected to one end of stick 22. A third actuator 32 may be connected between ground engaging tool 24 and stick 22. Third actuator 32 may be one or more hydraulically powered actuators, such as, for example, fluid motors or hydraulic cylinders. Alternatively, third actuator 32 may be any other appropriate device readily apparent to one skilled in the art as capable of moving ground engaging tool 24 relative to stick 22. Pressurized fluid may be introduced to third actuator 32 to move ground engaging tool 24 relative to stick 22. The direction and rate of the pressurized fluid flow to third actuator 32 may be controlled to thereby control the direction and speed of movement of ground engaging tool 24 relative to stick 22.

As also illustrated in FIG. 1, work machine 10 may include a first control 40 that is housed in body 12. First control 40 may include, for example, a microprocessor and a memory. As one skilled in the art will recognize, first control 40 may be configured to store an instruction set and variables.

First control 40 may be programmed to control the operation of work machine 10 based on instructions received from an operator. For example, first control 40 may be programmed to control the motion of work implement 18 relative to body 12 and the rotation of body 12 relative to base 14. First control 40 may be connected to a series of valves that control the rate and direction of fluid flow to and from each actuator. By actuating the valves in accordance with the commands of the operator, first control 40 may thereby control the motion of work implement 18 and ground engaging tool 24.

First control 40 may also govern the rate and direction of travel of work machine 10 based on commands from the operator. Work machine 10 may include a first transmitter 34 and a first receiver 36 to transmit operating instructions to base 14. First transmitter 34 may be configured to transmit a wireless transmission containing an information signal 38 to first receiver 36. The wireless transmission may be for example, a signal based on light, sound, heat, electrical, or magnetic principles. For example, the wireless transmission may be an infrared signal, a laser signal, or a radio frequency signal. One skilled in the art will recognize that any radiative signal may be used.

As shown in FIG. 2, first transmitter 34 may be disposed proximate opening 54 of first member 50. First transmitter 34 may be connected to first member 50 or to a part of body 12. First transmitter 34 may send a wireless transmission containing an information signal 38 across joint 16.

First receiver 36 may be disposed proximate opening 56 of second member 52. First receiver 36 may be connected to second member 52 or to a part of base 14. First receiver 36 may be configured to receive the wireless transmission sent by first transmitter 34.

One skilled in the art will recognize that first transmitter 34 and first receiver 36 may be disposed at any location on body 12 and base 14 that will allow communication of the wireless transmission. For example, first transmitter 34 and first receiver 36 may be positioned such that the wireless transmission may be sent through openings 54 and 56 of first and second members 50 and 52, respectively. Alternatively, the wireless transmission may be sent externally to openings 54 and 56 of first and second members 50 and 52, respectively.

As illustrated in FIG. 1, work machine 10 may include a second control 42 housed in base 14. Second control 42 may include, for example, a microprocessor and a memory. Second control 42 may also be configured to store an instruction set and variables. Second control 42 may be connected to first receiver 36 and may be programmed to receive and interpret informational signal 38.

Second control 42 may be programmed to control motor 43 and/or the steering mechanism in base 14. Second control 42 may control motor 43 based on commands received from the operator through informational signal 38. For example, if the operator provides an instructions to move work machine 10 in a first direction, second control 42 may apply an appropriate signal to engage motor 43 to drive ground engaging device 44 to thereby move work machine 10 in the desired direction.

As shown in FIG. 2, a second transmitter 60 may be disposed proximate opening 56 of second member 52. Second transmitter 60 may be connected to second member 52 or to a part of base 14. Second control 42 may be connected to second transmitter 60. Second control 42 may be configured to generate an informational signal 62 to be transmitted in a wireless transmission to a second receiver 58. Second receiver 58 may be disposed proximate opening 54 of first member 50. Second receiver 58 may be connected to first member 50 or another part of body 12. Second receiver may be connected to first control 40.

It should be noted that first transmitter 34, first receiver 36, second transmitter 60, and second receiver 58 may be any type of transmitter/receiver combination that is readily apparent to one skilled in the art. In addition, the wireless transmissions may be sent at any frequency, or range of frequencies, readily apparent to one skilled in the art. One skilled in the art will further recognize that first receiver 36 may be combined with second transmitter 60 and first transmitter 34 may be combined with second receiver 58 in a device such as, for example, a transceiver.

Second control 42 may generate informational signal 62 to relay information regarding the operation of base 14 to first control 40. The wireless transmission containing informational signal 62 may be transmitted across joint 16. The wireless transmission may be received by second receiver 58, which may relay informational signal 62 to first control 40. First control 40 may interpret and process informational signal 62.

Figure 3:
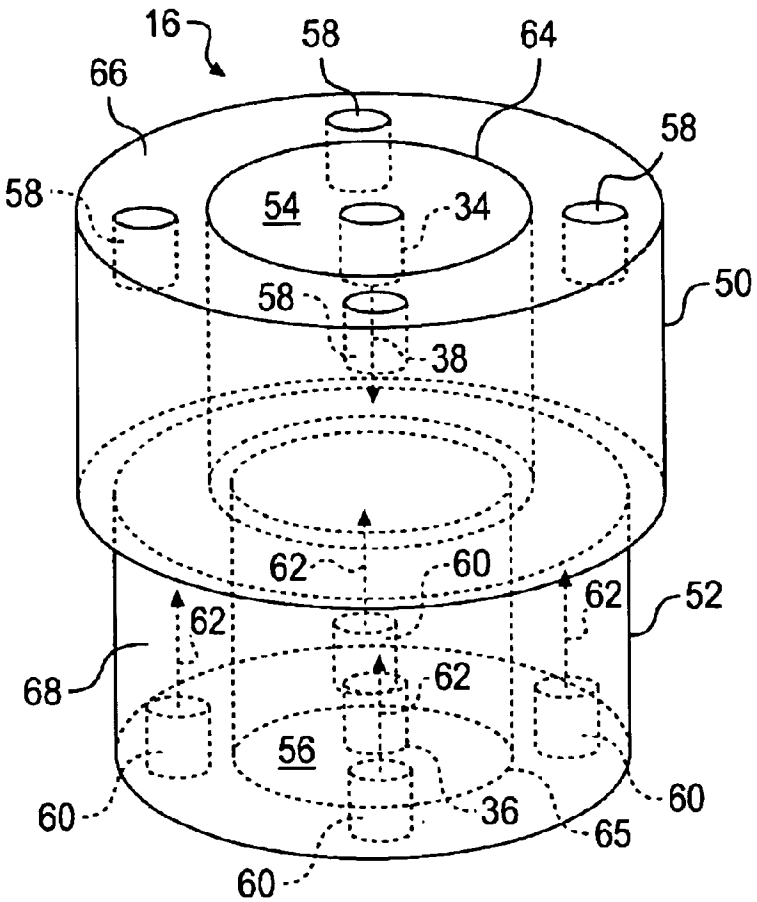
FIG. 3 is a schematic and diagrammatic representation of a joint in accordance with another exemplary embodiment of the present invention.

Another exemplary embodiment of joint 16 is illustrated in FIG. 3. As shown, first member 50 may include a first partition 64 that creates a third opening 66. Second member 52 may include a second partition 65 that creates a fourth opening 68.

A second set of transmitters 60 may be disposed proximate fourth opening 68 of second member 52 and may be connected to second control 42. A second set of receivers 58 may be disposed proximate third opening 66 of first member 50 and connected to first control 40.

Second set of transmitters 60 may transmit the wireless transmission through third opening 66 and fourth opening 68. First and second partitions 64 and 65 may prevent the wireless transmission containing information signal 62 from interfering with the wireless transmission containing information signal 38 being sent through openings 54 and 56 from first transmitter 34 to first receiver 36.

INDUSTRIAL APPLICABILITY

Work machine 10 may be any type of machine or vehicle that includes a swivel joint. For example, work machine 10 may be a wheeled excavator, a tracked excavator, a crane, a shovel logger, a front shovel, a dragline, a military machine, a manlift, a track feller buncher, a harvester, a forwarder, a clambunk, a knuckleboom loader, or a rock drill. One skilled in the art may recognize that the data transmission system described herein may also be applicable to other types of articulated joints, such as, for example, a pivoting link or pulley.

During the operation of work machine 10, an operator may provide an instruction to work machine 12 that requires communication between body 12 and base 14. For example, the operator may instruct work machine 10 to begin moving, to slow down, or to change direction. The operator may communicate this instruction to first control 40 by manipulating the appropriate control devices in the cab of body 12. The control devices are configured to translate the instruction from the operator into a control signal for first control 40.

Upon receipt of the instruction from the control devices, first control 40 may generate an informational signal 38 to be sent to base 14. First control 40 provides informational signal 38 to first transmitter 34, which transmits informational signal 38 across joint 16 to first receiver 36. First receiver 36 receives informational signal 38 and passes informational signal to second control 42.

Second control 42 interprets informational signal 38. Second control 42 then performs the task specified within information signal 38. For example, second control 42 may engage or disengage motor 43. Second control 42 may also operate a steering mechanism to change the direction of travel of work machine 10.

During the operation of work machine 10, information may also be communicated from base 14 to body 12. For example, second control 42 may send a confirmation signal to first control 40 to acknowledge receipt of informational signal 38. Second control 42 may also send other types of signals to first control 40. For example, second control 42 may send an error signal to indicate an operational problem in base 14. Second control 42 may also send an informational signal to first control 40. The informational signal may include confirmation that a previous instruction was completed. The informational signal may also provide a status of the operation of base 14, such as, for example, fuel level, track speed, steering direction, motor operation, fluid pressure, solenoid valve operation, stress/strain, position, or temperature.

Second control 42 may communicate with first control 40 by generating informational signal 62 (referring to FIG. 2). Second control may provide informational signal 62 to second transmitter 60, which transmits informational signal 62 across joint 16 to second receiver 58. Second receiver 58 receives informational signal 62 and relays the informational signal 62 to first control 40. First control 40 may interpret informational signal 62 and take any appropriate action, such as, for example, updating a status display for the operator.

As will be apparent from the foregoing description, the present invention provides a joint for a work machine that improves the range of motion of the work implement. The described transmitters and receivers remove the need for a physical connection, such as a "hard wire" connection or a "brush wire" connection between the base and the body of the work machine. Thus, the present invention improves the range of motion of the work implement of the work machine. In addition, the present invention will reduce the amount of maintenance required to ensure accurate communication between the base and the body of the work machine.

It will be apparent to those skilled in the art that various modifications and variations can be made in the joint of the present invention without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A joint for a work machine having a body and a base, comprising:

a first member connected to one of the body and the base;

a second member connected to the other of the body and the base, the second member engaged with the first member to allow the body to swivel relative to the base;

a first transmitter connected to the body, the first transmitter operable to transmit an informational signal; and a first receiver connected to the base, the first receiver operable to receive the informational signal;

a second transmitter connected to the base the second transmitter operable to transmit a second informational signal; and a second receiver connected to the body the second receiver operable to receive the second informational signal.

2. The joint of claim 1, further including a first controller operatively connected to the first transmitter and configured to generate the informational signal and a second controller operatively connected to the first receiver and configured to interpret the informational signal.

3. The joint of claim 1, wherein the first and second members are configured to allow the body to rotate through at least a 360° rotation relative to the base.

4. The joint of claim 1, wherein the first member includes a first partition and the second member includes a second partition, the first and second partitions defining a first opening and a second opening, and wherein said first transmitter transmits the informational signal through the first opening and the second transmitter transmits an informational signal through the second opening.

5. The joint of claim 1, wherein each of the first and second members have a generally cylindrical shape and an opening, and the opening of one of the first and second members is configured to receive the other of the first and second members therein.

6. The joint of claim 5, wherein the first transmitter transmits the informational signal through the openings of the first and second members.

7. The joint of claim 1, wherein the informational signal is one of a light, a sound, and a magnetic signal.

8. The joint of claim 1, wherein the first transmitter is operable to transmit a wireless informational signal and wherein the first receiver is operable to receive the wireless informational signal.

9. The joint of claim 1, wherein the first transmitter and the second receiver form a first transceiver and the second transmitter and the first receiver form a second transceiver.

10. A method of transmitting data in a work machine including a base, a body, and a joint connecting the base to the body, comprising:

generating an informational signal in the body of the work machine;

transmitting a wireless transmission containing the informational signal across the joint with a first transmitter connected with the body of the work machine;

receiving the informational signal through a first receiver connected with the base of the work machine;

generating a second informational signal in the base of the work machine;

transmitting a wireless transmission containing the second informational signal across the joint with a second transmitter connected with the base of the work machine; and receiving the second informational signal through a second receiver connected with the body of the work machine.

11. The method of claim 10, further including interpreting the informational signal.

12. The method of claim 10, further including swiveling the body through at least a 360° rotation relative to the base.

13. A joint for a work machine having a body and a base, comprising:

a first member connected to one of the body and the base;

a second member connected to the other of the body and the base, the second member engaged with the first member to allow the body to swivel relative to the base;

a first means for transmitting a first informational signal connected to the body;

a first means for receiving the first informational signal connected to the base;

a second means for transmitting a second informational signal connected to the base; and a second means for receiving the second informational signal connected to the body.

14. The joint of claim 13, further including a first control means operatively connected to the first means for transmitting and configured to generate the first informational signal and a second control means operatively connected to the first means for receiving and configured to interpret the first informational signal.

15. The joint of claim 13, wherein the first means for transmitting is a means for transmitting a wireless informational signal and wherein the first means for receiving is a means for receiving the wireless informational signal.

16. A work machine, comprising:

a base;

a body having a work implement;

a joint connecting the body and the base, the joint configured to allow a swiveling movement between the base and the body;

a first transmitter engaged with the body, the transmitter configured to transmit an informational signal;

a first receiver engaged with the base, the receiver configured to receive the informational signal transmitted by the transmitter;

a second transmitter engaged with the base the second transmitter configured to transmit a second informational signal; and a second receiver engaged with the body the second receiver configured to receive the second informational signal transmitted by the second transmitter.

17. The work machine of claim 16, further including a first control operatively connected to the first transmitter and configured to generate the informational signal and a second control operatively connected to the first receiver and configured to interpret the informational signal.

18. The work machine of claim 16, wherein the joint allows the body to rotate through 360° of rotation relative to the base.

19. The work machine of claim 16, wherein the joint includes a first member connected to the base and a second member connected to the body, each of the first and second members having a generally cylindrical shape and an opening, the opening of one of the first and second members being configured to receive the other of the first and second members therein.

20. The work machine of claim 19, wherein the first transmitter is connected to the first member and the first receiver is connected to the second member.

21. The work machine of claim 19, wherein the informational signal is transmitted through the openings in the first and second members.

22. The work machine of claim 19, further including a set of tracks associated with the base, and wherein the work implement includes a shovel mounted on a boom and a stick.

23. The work machine of claim 16, wherein the first transmitter is configured to transmit a wireless informational signal and wherein the first receiver is configured to receive the wireless informational signal.

24. A joint for a work machine having a body and a base, comprising:

a first member connected to one of the body and the base, the first member having a first opening;

a second member connected to the other of the body and the base, the second member having a second opening, the second member engaged with the first member to allow the body to swivel relative to the base;

a transmitter connected to one of the body and the base, the transmitter operable to transmit an informational signal through at least one of the first and second openings; and a receiver connected to the other of the body and the base, the receiver operable to receive the informational signal through at least one of the first and second openings.

25. The joint of claim 24, wherein the first and second members are engaged in a manner that the first and second openings are aligned.

26. The joint of claim 24, further including a first controller operatively connected to the transmitter and configured to generate the informational signal and a second controller operatively connected to the receiver and configured to interpret the informational signal.

27. The joint of claim 24, further including a second transmitter engaged with the other of the body and the base and a second receiver engaged with the one of the body and the base.

28. The joint of claim 24, wherein the transmitter is operable to transmit a wireless informational signal and wherein the receiver is operable to receive the wireless informational signal.

29. A work machine, comprising:

a base;

a ground engaging device associated with the base;

a body having a work implement;

a joint connecting the body and the base, the joint configured to allow a swiveling movement between the base and the body;

a transmitter engaged with the body, the transmitter being configured to wirelessly transmit a steering signal;

a receiver engaged with the base, the receiver being configured to receive the steering signal transmitted by the transmitter; and a control in communication with the receiver and configured to control steering of the work machine based on the steering signal.

30. The work machine of claim 29, wherein the steering signal includes at least one of a begin moving signal, a slow down signal, and a change direction signal.

31. A work machine, comprising:

a base;

a body having a seating area for an operator and having a work implement;

a joint connecting the body and the base, the joint configured to allow a swiveling movement between the base and the body;

a transmitter engaged with the base, the transmitter being configured to wirelessly transmit an informational signal;

a receiver engaged with the body, the receiver being configured to receive the informational signal transmitted by the transmitter.

32. The work machine of claim 31, wherein the informational signal includes at least one of a fuel level, a track speed, a steering direction, a solenoid valve operation, and a temperature.

* * * * *